US006745958B2

(12) United States Patent
Lei

(10) Patent No.: US 6,745,958 B2
(45) Date of Patent: Jun. 8, 2004

(54) DUAL CONTROL VALVE

(75) Inventor: Ning Lei, Oak Brook, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 192 days.

(21) Appl. No.: 10/105,482

(22) Filed: Mar. 25, 2002

(65) Prior Publication Data

US 2003/0146295 A1 Aug. 7, 2003

Related U.S. Application Data

(63) Continuation-in-part of application No. 10/072,490, filed on Feb. 5, 2002.

(51) Int. Cl.[7] ..... B05B 1/30; F02M 47/02

(52) U.S. Cl. ..... 239/585.2; 239/88; 239/585.3; 239/585.5; 239/533.8; 239/533.9

(58) Field of Search ..... 239/88, 89, 90, 239/91, 92, 533.2, 533.3, 533.8, 533.9, 585.1, 585.2, 585.3, 585.4, 585.5; 251/129.15, 129.21, 127

(56) References Cited

U.S. PATENT DOCUMENTS

| | | | | | |
|---|---|---|---|---|---|
| 3,501,099 | A | * | 3/1970 | Benson | 239/584 |
| 3,587,547 | A | * | 6/1971 | Hussey et al. | 123/447 |
| 3,752,137 | A | * | 8/1973 | Kimberley | 123/496 |
| 4,384,553 | A | * | 5/1983 | Schechter | 123/143 A |
| 5,241,935 | A | * | 9/1993 | Beck et al. | 123/300 |

* cited by examiner

*Primary Examiner*—Davis Hwu
(74) *Attorney, Agent, or Firm*—Dennis Kelly Sullivan; Susan L. Lukasik; Jeffrey P. Calfa

(57) ABSTRACT

A control apparatus for a unit fuel injector, the injector internally preparing fuel during an injection event at a pressure sufficient for injection into an internal combustion engine by means of an intensifier piston includes a selectively actuatable controller being in fluid communication with a source of pressurized actuating fluid and being in fluid communication with a substantially ambient actuating fluid reservoir, the controller having a first valve for selectively independently porting actuating fluid to and venting actuating fluid from the intensifier piston and a second valve for selectively independently porting actuating fluid to and venting actuating fluid from a needle valve during the injection event for controlling opening and closing of the needle valve. The control apparatus may also control an engine intake/exhaust valve. An engine valve actuator and methods of control are further included.

41 Claims, 7 Drawing Sheets

OFF POSITON
FIG. 2
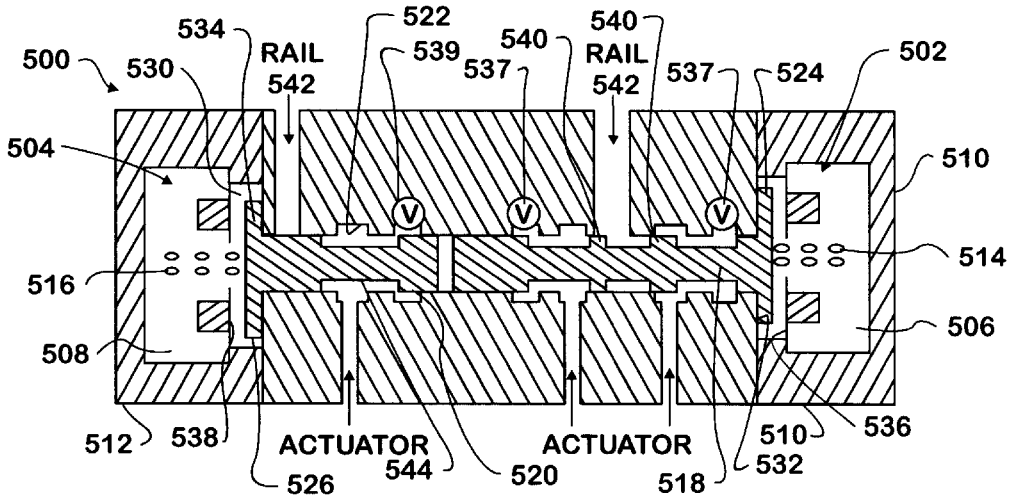
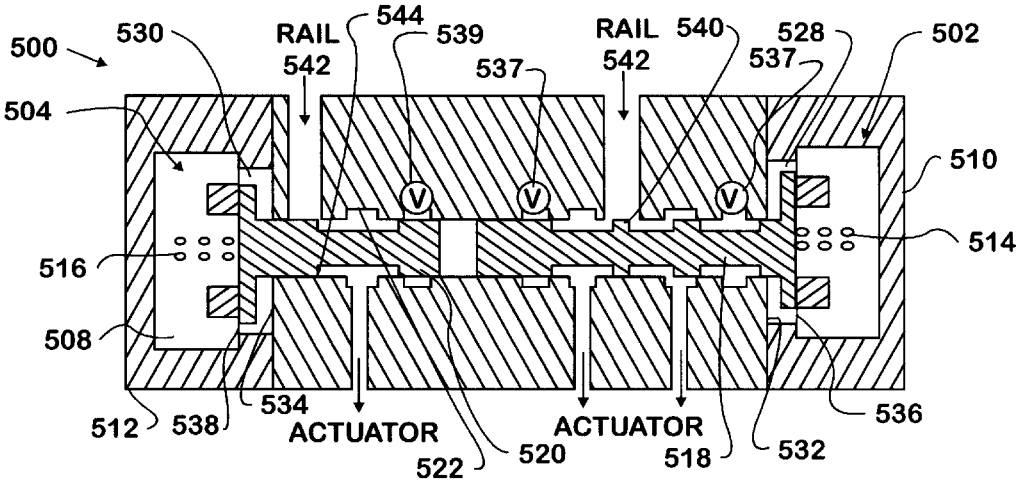
ON POSTION
FIG. 3

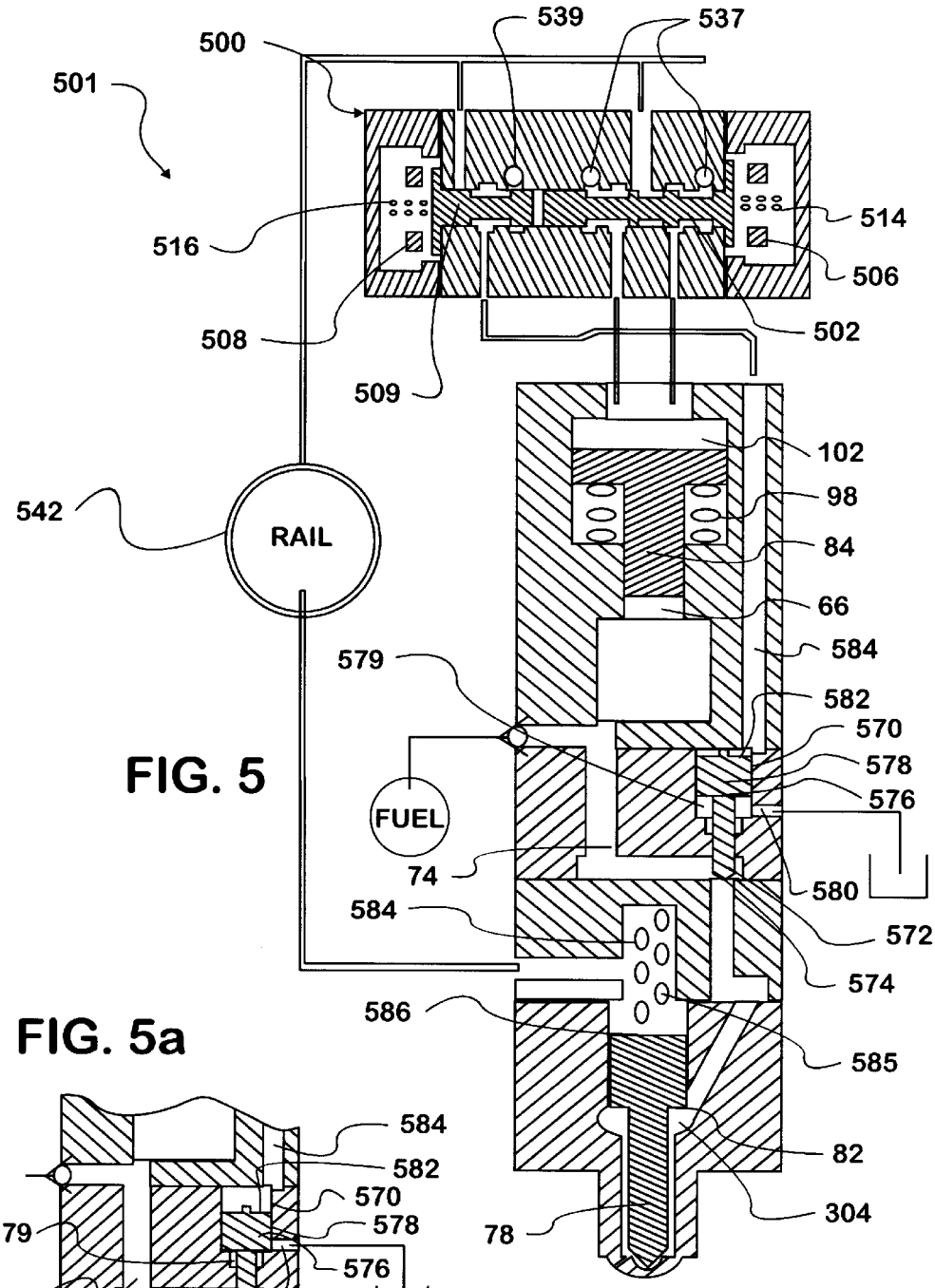
FIG. 5
FIG. 5a
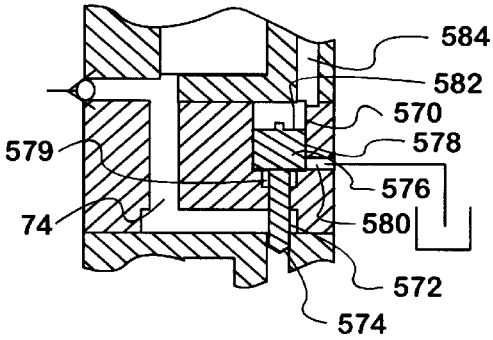

DUAL CONTROL VALVE

RELATED APPLICATIONS

The present application is a continuation-in-part application of U.S. patent application Ser. No. 10/072,490, filed Feb. 5, 2002.

TECHNICAL FIELD

The present application relates to internal combustion engine valve control. More particularly, the present application relates to needle valve control in a fuel injector and to camless control of engine intake/exhaust valves.

BACKGROUND AND PRIOR ART

Referring to the prior art drawings, FIG. 1 shows a prior art fuel injector 50. The prior art injector 50 is substantially as described in U.S. Pat. No. 5,460,329 to Sturman. A fuel injector having certain similar features may be found in U.S. Pat. No. 5,682,858 to Chen et al, The fuel injector 50 is typically mounted to an engine block and injects a controlled pressurized volume of fuel into a combustion chamber (not shown). The injector 50 is typically used to inject diesel fuel into a compression ignition engine, although it is to be understood that the injector could also be used in a spark ignition engine or any other system that requires the injection of a fluid.

The fuel injector 50 has an injector housing 52 that is typically constructed from a plurality of individual parts. The housing 52 includes an outer casing 54 that contains block members 56, 58, and 60. The outer casing 54 has a fuel port 64 that is coupled to a fuel pressure chamber 66 by a fuel passage 68. A first check valve 70 is located within fuel passage 68 to prevent a reverse flow of fuel from the pressure chamber 66 to the fuel port 64. The pressure chamber 66 is coupled to a nozzle chamber 304 and to a nozzle 72 by means of fuel passage 74. A second check valve 76 is located within the fuel passage 74 to prevent a reverse flow of fuel from the nozzle 72 and the nozzle chamber 304 to the pressure chamber 66. The flow of fuel through the nozzle 72 is controlled by a needle valve 78 that is biased into a closed position by spring 80 located within a spring chamber 81. The needle valve 78 has a shoulder 82 in the nozzle chamber 304 above the location where the passage 74 enters the nozzle 78. When fuel flows in the passage 74, the pressure of the fuel applies a force on the shoulder 82 in the nozzle chamber 304. The shoulder force acts to overcome the bias of spring 80 and lifts the needle valve 78 away from the nozzle 72, allowing fuel to be discharged from the injector 50.

A passage 83 may be provided between the spring chamber 81 and the fuel passage 68 to drain any fuel that leaks into the chamber 81. The drain passage 83 prevents the build up of a hydrostatic pressure within the chamber 81 which could create a counteractive force on the needle valve 78 and degrade the performance of the injector 50.

The volume of the pressure chamber 66 is defined in part by an intensifier piston 84. The intensifier piston 84 extends through a bore 86 of block 60 and into a first intensifier chamber 88 located within an upper valve block 90. The piston 84 includes a shaft member 92 which has a shoulder 94 that is attached to a head member 96. The shoulder 94 is retained in position by clamp 98 that fits within a corresponding groove 100 in the head member 96. The head member 96 has a cavity which defines a second intensifier chamber 102.

The first intensifier chamber 88 is in fluid communication with a first intensifier passage 104 that extends through block 90. Likewise, the second intensifier chamber 102 is in fluid communication with a second intensifier passage 106.

The block 90 also has a supply working passage 108 that is in fluid communication with a supply working port 110. The supply working port 110 is typically coupled to a system that supplies a working fluid which is used to control the movement of the intensifier piston 84. The working fluid is typically a hydraulic fluid, preferably engine lubricating oil, that circulates in a closed system separate from fuel. Alternatively the fuel could also be used as the working fluid. Both the outer body 54 and block 90 have a number of outer grooves 112 which typically retain O-rings (not shown) that seal the injector 10 against the engine block. Additionally, block 62 and outer shelf 54 may be sealed to block 90 by O-ring 114.

Block 60 has a passage 116 that is in fluid communication with the fuel port 64. The passage 116 allows any fuel that leaks from the pressure chamber 66 between the block 62 and piston 84 to be drained back into the fuel port 64. The passage 116 prevents fuel from leaking into the first intensifier chamber 88.

The flow of working fluid (preferably engine lubricating oil) into the intensifier chambers 88 and 102 can be controlled by a four-way solenoid control valve 118. The control valve 118 has a spool 120 that moves within a valve housing 122. The valve housing 122 has openings connected to the passages 104, 106 and 108 and a drain port 124. The spool 120 has an inner chamber 126 and a pair of spool ports that can be coupled to the drain ports 124. The spool 120 also has an outer groove 132. The ends of the spool 120 have openings 134 which provide fluid communication between the inner chamber 126 and the valve chamber 134 of the housing 122. The openings 134 maintain the hydrostatic balance of the spool 120.

The valve spool 120 is moved between the first position shown in prior art FIG. 1 and a second opposed position, by a first solenoid 138 and a second solenoid 140. The solenoids 138 and 140 are typically coupled to an external controller (not shown) which controls the operation of the injector. When the first solenoid 138 is energized, the spool 120 is pulled to the first position, wherein the first groove 132 allows the working fluid to flow from the supply working passage 108 into the first intensifier chamber 88, and the fluid flows from the second intensifier chamber 102 into the inner chamber 126 and out the drain port 124. When the second solenoid 140 is energized the spool 120 is pulled to the second position, wherein the first groove 132 provides fluid communication between the supply working passage 108 and the second intensifier chamber 102, and between the first intensifier chamber 88 and the drain part 124.

The groove 132 and passages 128 are preferably constructed so that the initial port is closed before the final port is opened. For example, when the spool 120 moves from the first position to the second position, the portion of the spool adjacent to the groove 132 initially blocks the first passage 104 before the passage 128 provides fluid communication between the first passage 104 and the drain port 124. Delaying the exposure of the ports reduces the pressure surges in the system and provides an injector which has predictable firing points on the fuel injection curve.

The spool 120 typically engages a pair of bearing surfaces 142 in the valve housing 122. Both the spool 120 and the housing 122 are preferably constructed from a magnetic material such as a hardened 52100 or 440c steel, so that the hystersis of the material will maintain the spool 120 in either the first or second position. The hystersis allows the solenoids 138, 140 to be de-energized after the spool 120 is pulled into position. In this respect the control valve 118 operates in a digital manner, wherein the spool 120 is moved by a defined power pulse that is provided to the appropriate solenoid 138, 140. Operating the valve 118 in a digital manner reduces the heat generated by the coils and increases the reliability and life of the injector 50.

In operation, the first solenoid 138 is energized and pulls the spool 120 to the first position, so that the working fluid flows from the supply port 110 into the first intensifier chamber 88 and from the second intensifier chamber 102 into the drain port 124. The flow of working fluid into the intensifier chamber 88 moves the piston 84 and increases the volume of chamber 66. The increase in the chamber 66 volume decreases the chamber pressure and draws fuel into the chamber 66 from the fuel port 64. Power to the first solenoid 138 is terminated when the spool 120 reaches the first position.

When the chamber 66 is filled with fuel, the second solenoid 140 is energized to pull the spool 120 into the second position. Power to the second solenoid 140 is terminated when the spool 120 reaches the second position. The movement of the spool 120 allows working fluid to flow into the second intensifier chamber 102 from the supply port 110 and from the first intensifier chamber 88 into the drain port 124.

The head 96 of the intensifier piston 96 has an area much larger than the end of the piston 84, so that the pressure of the working fluid generates a force that pushes the intensifier piston 84 and reduces the volume of the pressure chamber 66. The stroking cycle of the intensifier piston 84 increases the pressure of the fuel within the pressure chamber 66 and, by means of passage 74, in the nozzle chamber 304. The pressurized fuel acts on shoulder 82 in the nozzle chamber 304 to open the needle valve 78 and fuel is then discharged from the injector 50 through the nozzle 72. The fuel is typically introduced to the injector at a pressure between 1000–2000 psi. In the preferred embodiment, the piston has a head to end ratio of approximately 10:1, wherein the pressure of the fuel discharged by the injector is between 10,000–20,000 psi.

The HEUI injector 50 described above is commonly referred to as the G2 injector. The G2 injector 50 uses a fast digital spool valve 120 to control multiple injection events. During its operation, every component inside of the injector 50 (spool valve 120, intensifier piston 84, and needle valve 78) has to open/close multiple times to either trigger the injection or stop the injection during the injection event. The digital spool valve 120 has to handle large flow capacity to supply actuation liquid to the intensifier piston 78. The spool valve 120 size is relatively big and the response of a large spool valve 120 is therefore limited.

The intensifier 84 is also relatively large in mass. Therefore reversing the motion of the intensifier 84 to achieve pilot injection operation is inefficient. Once committed to compression of fuel for injection, it is much more efficient to maintain the intensifier 84 motion in the compressing stroke throughout the duration of the injection event.

Reversing of the motion of the spool valve 120 and the intensifier piston 84 results in the injection event no longer being a single shot injection, but effectively multiple short independent injection events during the injection event. Both the motion of the spool valve 120 and the intensifier piston 84 must be reversed in the duration between the pre-injection and the actual injection and reversed again to effect the "actual" injection. With such relatively massive devices as the spool valve 120 and the intensifier piston 84, this is highly inefficient.

It is believed that pilot or split injection should be injection interruptions effected during a single shot injection, e.g., with no motion reversal of either the spool valve 120 or the intensifier piston 84, but with control of the needle valve 78 opening and closing motions. As indicated above, the intensifier piston 84 has relatively large mass hence it is difficult or slow to reverse its motion.

A responsive injection system should avoid reverse motion of the intensifier 84 and, preferably, of the spool valve 120. Therefore, there is a need in the industry to utilize a mechanism to efficiently control the needle valve 78 independent of intensifier piston 84 and its controller.

There is further a need for camless control of engine intake/exhaust valves. This need is highlighted by the ever more stringent emission requirements and the need to continue to produce adequate power and torque while meeting the more stringent emission requirements. Intake/exhaust valve operation that is solely a function of the rotational motion of the engine does not provide the flexibility to achieve both of the foregoing requirements. More flexible control of engine intake/exhaust valves is needed for the future. A controller that could perform both the control needed in the fuel injector and control of engine intake/exhaust valves would be ideal from a commonality of parts standpoint and from a development risk and cost standpoint.

SUMMARY OF THE INVENTION

The present invention substantially meets the needs of the industry. Control of the needle valve multiple times during an injection event is achieved by a device that permits the spool valve to cycle only a single time, open at the initiation of the injection event and close after the termination of the injection event, and the intensifier piston to maintain a continuous compressing stroke during the injection event. The same control device is applicable to actuation of an engine intake/exhaust valve, replacing a conventional cam as the valve actuating component.

The present invention is a control apparatus for a unit fuel injector, the injector internally preparing fuel during an injection event at a pressure sufficient for injection into an internal combustion engine by means of an intensifier piston and includes a selectively actuatable controller being in fluid communication with a source of pressurized actuating fluid and being in fluid communication with a substantially ambient actuating fluid reservoir, the controller having a first valve for selectively independently porting actuating fluid to and venting actuating fluid from the intensifier piston and a second valve for selectively independently porting actuating fluid to and venting actuating fluid from a needle valve during the injection event for controlling opening and closing of the needle valve. The control apparatus may also control an engine intake/exhaust valve and may be employed in conjunction with a unique valve actuator. An engine valve actuator and methods of control are further included.

BRIEF DESCRIPTION OF THE DRAWINGS

FIG. 2 is a sectional view of the dual control valve of the present invention with both valves on the off position;

FIG. 3 is a sectional view of the dual control valve of the present invention with both valves on the on position;

FIG. 5 is a sectional view of a second embodiment of a fuel injector incorporating the dual control valve of the present invention;

FIG. 5*a* is a sectional view of a second embodiment of a fuel injector incorporating the dual control valve of the present invention with the blocking pin in a closed disposition;

DETAILED DESCRIPTION OF THE DRAWINGS

Figure 4:
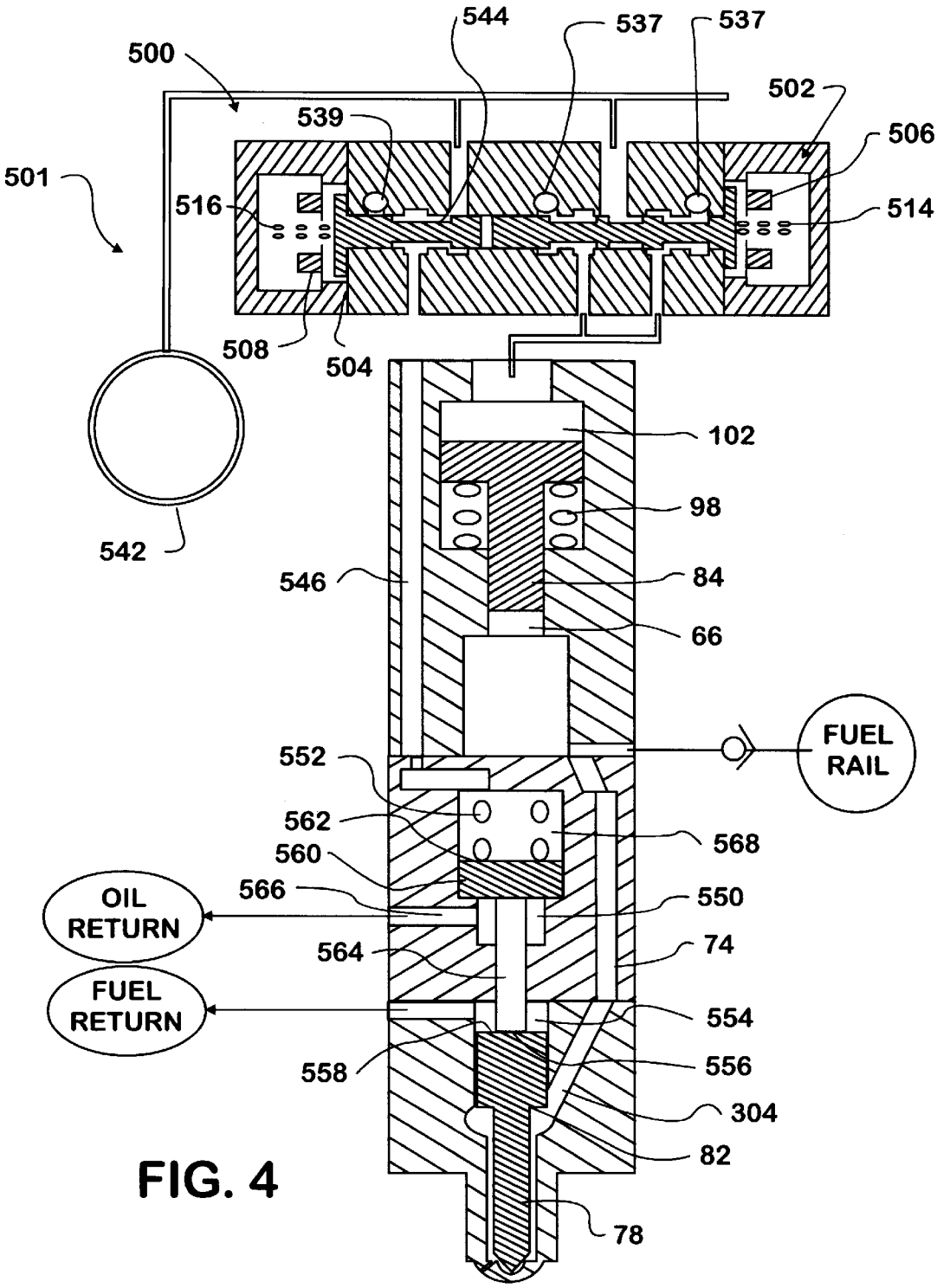
FIG. 4 is a sectional view of a fuel injector incorporating the dual control valve of the present invention.

The dual control valve of the present invention is shown generally at 500 in the FIGS. 2 and 3. The application of the dual control valve 500 to a fuel injection system is depicted in FIGS. 4 and 5 and to engine valve actuation in FIGS. 6–8.

Referring to FIGS. 2 and 3, the dual control valve 500 has two major components, pressure control valve 502 and timing control valve 504. The pressure control valve 502 and timing control valve 504 of the control valve 500 each include a dedicated respective control coil 506, 508, cap assemblies 510, 512, and respective return springs 514, 516. The pressure control valve 502 preferably includes a single balanced spool valve 518. The timing control valve 504 is comprised of a half spool valve 520 (The timing control valve 504 may also be a poppet valve or other valve having relatively small moving mass to provide for an enhanced response time). Both valves 502, 504 are depicted in a coaxial relationship being on the same longitudinal axis and in this configuration may be installed from both ends in a bore 522 defined in a common housing 524. It should be noted that the valves 502, 504 need not be in the depicted coaxial disposition.

Both valves 502, 504 are never in physical contact with each other in any operating condition and accordingly the valves 502, 504 can be operated independently without interference. Both valves 502, 504 are electronically energized to the on position of FIG. 3 and returned by the respective return spring 514, 516 to the off position of FIG. 2. Both spool valves 502, 504 have a respective large disk plate 524, 526 at one end (air gap side 528, 530) to provide a large magnetic force to provide for actuation of the respective spool valves 502, 504. The disk plates 524, 526 also provide a stop function to the respective spool valves 502, 504 When the respective disk plate 524, 526 has reached (is seated on) either the respective valve housing stop 532, 534 or the respective end cap stop 536, 538. Actuating fluid flows from the high pressure rail 542 to a selected actuator as controlled by the valves 502, 504. Actuating fluid is vented from the selected actuator to a substantially ambient reservoir via vents 537, 539 as controlled by the respective valves 502, 504.

The large balanced spool valve 518 is preferably a flow symmetric valve. Actuating fluid flow therefore goes into both the left and right sides of the lands 540 (flows fully around the lands 540, thereby equalizing the forces generated on both sides of the lands 540) when the spool valve 518 is in the open position and flow is from rail 542 (see FIG. 3) or in the closed position and flow is vented through vents 537 (see FIG. 2). The symmetric flow pattern around the lands 540 allows the spool valve 518 to shift between the off and on positions with very little or negligible flow force, hence the spool valve 518 provides for more efficient use of magnetic force and has a faster valve response. Symmetric flow around the lands 540 also provides for a relatively greater flow area and therefore has the advantage of a smaller valve stroke necessary to achieve the required porting of fluid.

The timing control valve 504 can either be a part of the balanced spool valve, for example, a half spool valve 520, or the timing control valve 504 may be a small poppet valve (not shown). The design objective of the timing control valve 504 is to make valve 504 as small as possible in order that the valve 504 has the fastest possible response time. A half spool valve 504 has less flow capability than a balanced spool valve, such as spool valve 518, but has faster response time since it has substantially less moving mass.

It should be noted that in the off position of FIG. 2, both valves 502, 504 are venting, the pressure control valve 502 venting actuating fluid to the vents 537 and the timing control valve 504 venting actuating fluid to the vent 539. Conversely, in the on position of FIG. 3, both valves 502, 504 are porting actuating fluid in, the pressure control valve 502 porting actuating fluid to a first actuator and timing control valve 504 porting actuating fluid to a second actuator.

When the dual control valve is employed to control fuel injection, actuation fluid from the rail 542 is directed to and vented from a different part of the injector hydraulic system independently both in timing and in duration through the coordination of the independent operation both control valves 502, 504. Following are examples of how the dual control valve 500 is employed to enhance the injection performance.

Fuel Injector Application

Figure 1:
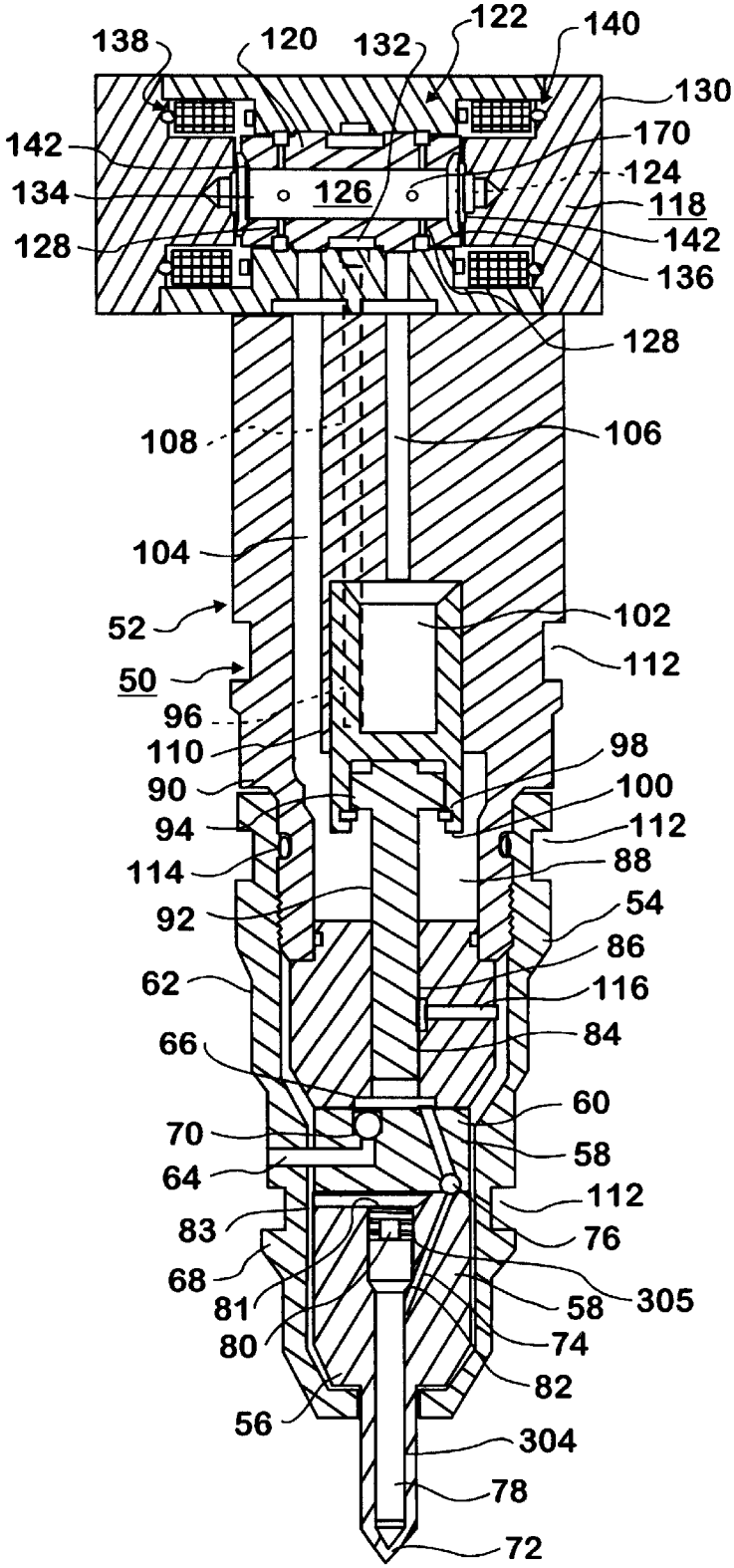
FIG. 1 PRIOR ART
FIG. 1 is a sectional view of a prior art fuel injector.

FIGS. 4 and 5 show the application of the present invention to a fuel injection system. The prior art injector 50 of FIG. 1 has a single two-position 3-way control valve 120. This single control valve 120 is replaced by the two-position 3-way valves 502, 504 of the dual control valve 500, the valves 502, 504 physically occupying the same space in the injector 501 as was occupied by control valve 120 in the injector 50, but functioning in a totally different way, as discussed in more detail below. Throughout these two embodiments as are described below, a balanced spool valve 518 of the pressure control valve 502 is always used to control the actuation process of the intensifier piston 84. The half spool valve 520 of the timing control valve 504 is used to control the timing of the injection and how much fuel is injected through the needle valve 78. By having two independent control valves 502, 504, the injection pressure generation process through the intensifier piston 84 and the injection timing control process through the needle valve 78 are managed independently. The difference between the fuel injector 501 embodiments as depicted in FIGS. 4 and 5 is primarily in how the timing control valve 504 is used.

Common to the injectors 501 of FIGS. 4 and 5, the pressure control valve 502 can be turned on ahead of the timing control valve 504 as desired and, when in the on position, actuates the intensifier piston 84 to prepare the fuel pressure and get ready for injection. The pressure control valve 502 preferably opens only once during an injection event and stays open throughout the injection event to provide constant injection pressure throughout the entire injection process. This allows the intensifier piston 84 to stay in either a down stroke compression motion or in a hydraulic lock mode with actuation fluid pressure applied to the intensifier piston 84 (hydraulic lock occurring when the timing control valve 504 ports actuating fluid to the needle valve 78, thereby closing the needle valve 78 and the entire fuel injection process is stopped) as controlled independently by the timing control valve 504. The pressure control valve 502 is preferably shut off to vent actuating fluid through vents 537 (see FIG. 2) only when the entire fuel injection event, including, for example, pilot, main and post injection, is finished. The pressure control valve 502, preferably the balance spool valve 518, is relatively large. Being flow balanced, the pressure control valve 502 has less flow restriction than an unbalanced valve. Since the valve 518 is typically cycled only once during an injection event, the response of the balance spool valve 518 is not as critical as the response of the small half spool valve 520 of the timing control valve 514, which may be cycled multiple times during an injection event.

Direct Needle Control

FIG. 4 shows the first embodiment of direct needle control using the dual control valve 500 of the present invention in the injector 501. The dual control valve 500 acts in cooperation with a needle actuation piston 550 to provide the desired injection control.

The needle actuation piston 550 has two control chambers, a lower chamber 560 and an upper chamber 562. Actuating fluid in the lower chamber 560 bears on the surface 564 to exert a downward force on the needle valve 78. The lower chamber 560 is exposed to the rail pressure at all times to provide a variable pressure force on the needle valve 78 as a function of the pressure in the rail 542. The passage to the lower chamber that ports in actuating fluid may be throttled as desired by orifice 566. Typically, the pressure in the rail 542 is less at idle conditions than at relatively higher engine RPM and higher load conditions.

Pressure in the upper chamber 562 is controlled through the timing control valve 504. The upper chamber 562 is vented to ambient pressure when the timing control valve 504 is off. The upper chamber 562 is pressurized when the timing coil 508 is turned on, shifting the timing control valve 504 to the on disposition.

In a mode of operation, the timing control valve 504 is maintained in the off, venting disposition throughout the injection event. In this mode, injection form the injector 501 functions in a manner that bears some similarity to the prior art injector 50, e.g. the injection is controlled solely by the pressure control valve 502. The additional improving feature is that the needle valve 78 advantageously has variable valve opening pressure (VOP). This variable VOP is effected by continuously exposing the surface 564 in the lower chamber 560 to actuating fluid at the then current pressure in the rail 542. VOP of the needle valve 78 then is the sum of the preload of the spring 552 and the force exerted on the needle valve 78 by the actuating fluid pressure bearing on the surface 564. Since the pressure in the rail 542 is variable, the VOP is variable. With variable VOP the needle valve 78 is readily openable at the very low rail pressure in the rail 542 at engine idle conditions to achieve better noise generation characteristics, while still maintaining very good elevated closing pressure for low emissions when the rail pressure in the rail 542 is elevated at higher engine RPM.

With the timing control valve 504 of the dual control valve 500, needle-opening pressure for the needle valve 78 can be achieved through two ways (in addition to the above described mode in which the timing control valve 504 is maintained in the off, venting disposition):

Assisted Needle Valve Closing Pressure. The timing control valve 504 is positioned in the off position, as depicted in FIG. 2, prior to commencement of the injection event command to the pressure control valve 502. In this method, the upper chamber 562 is vented to ambient through the vent 539 before needle valve 78 opening. Fuel pressure in chamber 66 builds after the pressure control valve 502 is shifted to the on position (see FIG. 3) at the commencement of the injection event. This pressurized fuel is transmitted to the shoulder surface 82 of the needle valve 78. The force on the shoulder surface 82 acts in opposition to both the preload of the return spring 552 and the Variable VOP chamber pressure force generated by the rail pressure acting on the surface 564 in the lower chamber 560. As fuel pressure rises, the needle valve 78 opens against the preload of the needle return spring 552 and rail pressure on the surface 564 in the bottom actuator chamber 560.

In this mode of operation, the timing control valve 504 can be turned on to pressurizes the chamber 562 at any time during the injection event. The resulting force exerted on the surface 568 in conjunction with the force of the rail pressure on the surface 564 will cause the needle valve 78 to close without regard to the pressure of the pressurized fuel acting in opposition on shoulder surface 82. This closing can achieve, for example, pilot injection followed by a dwell period during which no injection is taking place (the intensifier piston 84 being in a condition of hydraulic lock) before main injection (chamber 562 being vented by the timing control valve 504, thereby unlocking the intensifier piston 84 and resuming the compressive stroke of the intensifier piston 84) during a single injection event.

(2) Assisted Needle Valve Opening Pressure. The second method of achieving needle-opening pressure for the needle valve 78 with the embodiment of FIG. 5 is to use the timing control valve 504 to interfere. In this method, the timing control coil 508 is on (see FIG. 3) before the pressure control valve 502 is shifted to on (see also FIG. 3) at the commencement of the injection event. The upper actuator chamber 562 is fully charged with rail pressure ported in by the timing control valve 504 and the area of the surface 568 magnifies the rail pressure. With all the forces (preload of the return spring 552 and rail pressure acting on the area of the surfaces 564, 568) on the needle valve 78, the needle valve 78 cannot open until the timing control valve 504 is shifted from the on position to the off position and the pressure acting on the surface 568 in the upper chamber 562 is thereby vented to ambient through the vent 539 without regard to the position of the pressure control valve 502. Once this venting occurs, the needle valve 78 is free to open as described with reference to method (1) immediately above, and will open if the pressure control valve 502 is on and porting actuating fluid to the intensifier piston 84. End of injection is effected either by shifting the timing control valve to the on position or by shifting the pressure control valve 502 to the off position.

Needle valve closing in both methods (1) and (2) is always controlled by turning on the timing control valve 504 to pressurize the upper actuation chamber 562. Pressurizing the upper actuation chamber 562 always generates sufficient force on the needle valve 78 to overcome the force in opposition exerted by the high pressure fuel acting on shoulder surface 82 and results in closure of the needle valve 78.

As noted above, a way to terminate injection to complete the injection event is to shift the timing control valve to the on position. The pressure control valve 502 is still in the on position of FIG. 3 and the intensifier piston 84 is still pressurizing fuel for injection, but is in a condition of hydraulic lock. Once the pressure control valve 502 is shifted to off as depicted in FIG. 2, the actuation fluid to the intensifier piston vents to ambient through the vents 537 and the intensifier piston 84 reverses direction and returns upward to its initial disposition under the control of the return spring 98. The timing control valve 504 can then be turned off to relax the closing pressure on the needle back 558 by venting the pressure in the upper chamber 562.

Controlled High Pressure Fuel Passage

FIG. 5 illustrates a further embodiment of the dual control valve 500 of the present invention to control injection in the injector 501. Control of the needle valve 78 by the timing control valve 504 in this embodiment is with the cooperation of a pin type actuation device 570 installed at the high-pressure fuel passage 74.

This pin actuator 570 may be referred to as a blocking pin and is employed to control flow in the passage 74. Control is effected by withdrawing the pin actuator 570 from the passage 74 to permit fuel flow in the passage 74 and thence to the nozzle chamber 304 and by interjecting the pin actuator 570 into the passage 74 to block normal fuel flow in the passage 74. The tip 574 of the point 572 is exposed to fuel pressure in passage 74 at all times. The backside 576 of the point 572 is in mechanical contact with the actuation piston 578. The variable volume chamber 579 in which the backside 576 is disposed is always vented to low (substantially ambient) pressure by vent 580. The actuation piston chamber 582 is disposed opposite to the chamber 579 and the volume of the actuation piston chamber 582 is variable as the inverse of the chamber 579. Pressure in the actuation piston chamber 582 is controlled by the timing control valve 504 acting through flow passage 584.

In a first mode of operation, the timing control valve 504 is not used (remains in the off, venting position) during the injection process. The injector 501 accordingly behaves similar to the baseline injector 50, excepting the unique variable VOP feature that is a function of rail pressure being continuously ported to the needleback chamber 584 to bear on the needleback surface 586 as is described above in greater detail with reference to the embodiment of FIG. 4. In this situation, the blocking pin 572 is always retracted out of the way due to fuel pressure acting on the pin tip surface 574 forcing the pin 572 to stay at the unblocking retracted position of FIG. 5. In such disposition, fuel readily flows around the pin tip surface 574 to the nozzle chamber 304 to effect opening of the needle valve 78 for the injection of fuel.

A second mode of operation provides for pilot injection. During a pilot injection event, the pressure control valve 502 is turned on first (the timing control valve 504 is off and venting and the pin 572 is retracted) to build up the injection pressure. The needle valve 78 opens when pressure in the nozzle chamber 304 acting on the shoulder 82 exceeds the variable VOP level. Soon after the needle valve 78 opens, the timing control valve 504 is turned on to port in high pressure actuating fluid and the actuation piston chamber 582 is pressurized. Due to the large piston area of the actuation piston 578 exposed to the actuating fluid pressure, the actuating pin 570 overcomes the force of the high pressure fuel in passage 74 acting in opposition on the pin tip surface 574. The pin 572 is forcibly shifted to the closed disposition as depicted in FIG. 5*a*, moving into the fuel passage 74 to block the fuel flow. Lack of fuel supply to nozzle chamber 304 and continued fuel injection causes the pressure in the nozzle chamber 304 to drop quickly and the needle valve 78, closes under the influence of the return spring 585 and the pressure of the actuating fluid acting on the needleback surface 586. The blocking duration effected by the closed actuating pin 570 becomes the dwell following the pilot injection and main injection is triggered by removing the actuating pin 570 from the passageway 74. This is accomplished by the timing control valve 504 venting the actuating fluid in the chamber 582, the very high fuel pressure in the passage 74 acting on the pin tip surface 574 to shift the actuating pin 570 to the retracted, open disposition of FIG. 5.

In a third mode of operation, the actuating pin 570 may be extended to the closed disposition of FIG. 5*a* ahead of the intensifier pressurization process as initiated by the pressure control valve 502 porting actuating fluid to the intensifier piston 84. After injection pressure is built in the chamber 66 by the compression stroke of the intensifier piston 84, the timing control valve 504 is shifted to the vented disposition, relieving the pressure on the surface 582. The high pressure fuel in the passage 74 then shifts the actuating pin 570 to the retracted, open disposition of FIG. 5. Injection ramps up nearly instantaneously to the maximum rate of injection. This produces an essentially square rate of the injection, since fuel pressure is being prebuilt in chamber 66 before the fuel is released to the nozzle chamber 304. Injection is terminated nearly instantaneously by the timing control valve 504 again porting actuating fluid to the surface 582 to shift the actuating pin 570 to the extended, closed disposition of FIG. 5*a*.

Engine Valve Actuation

Figure 6:
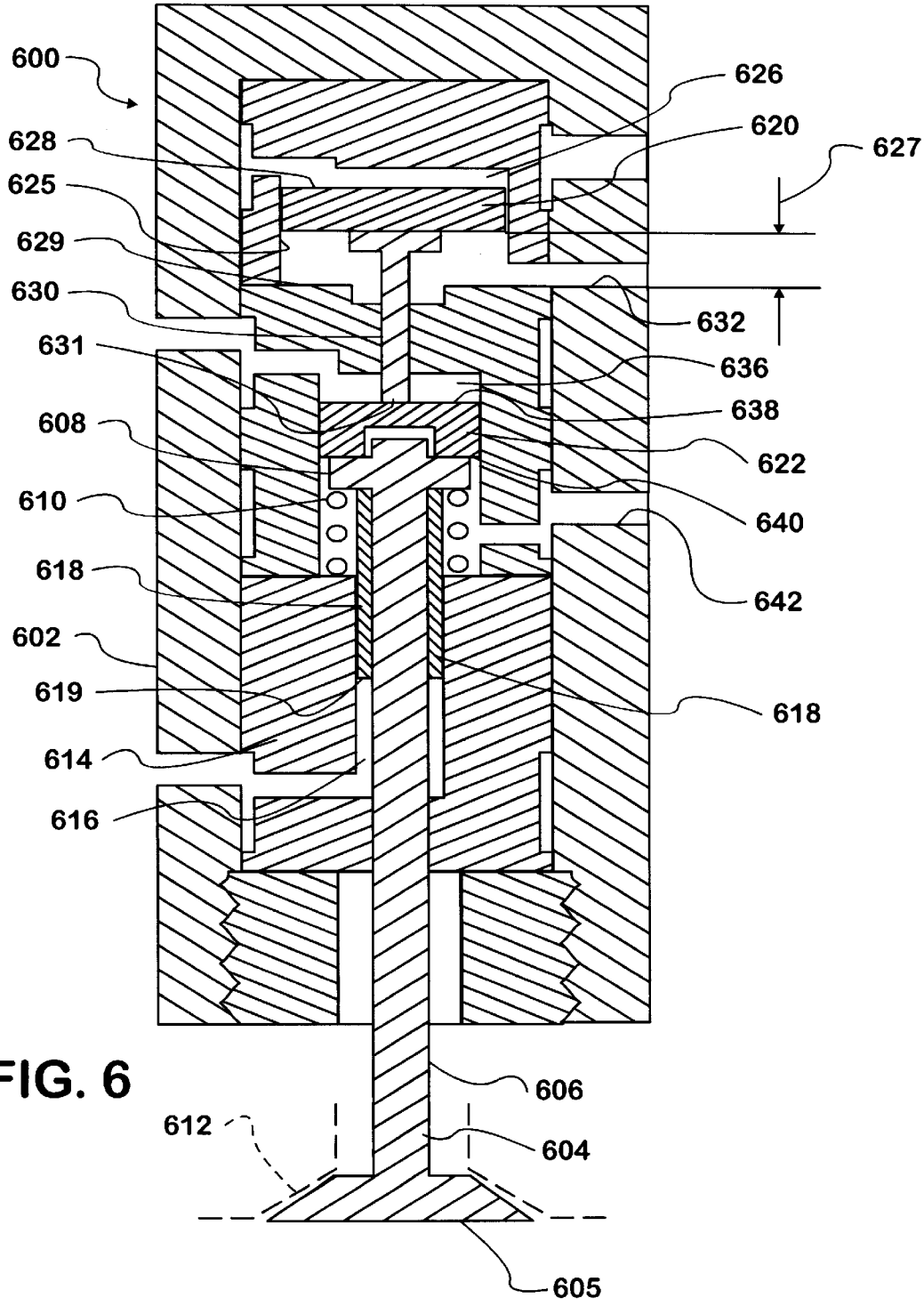
FIG. 6 is a sectional view of an engine intake/exhaust valve actuation device of the present invention.
Figure 7:
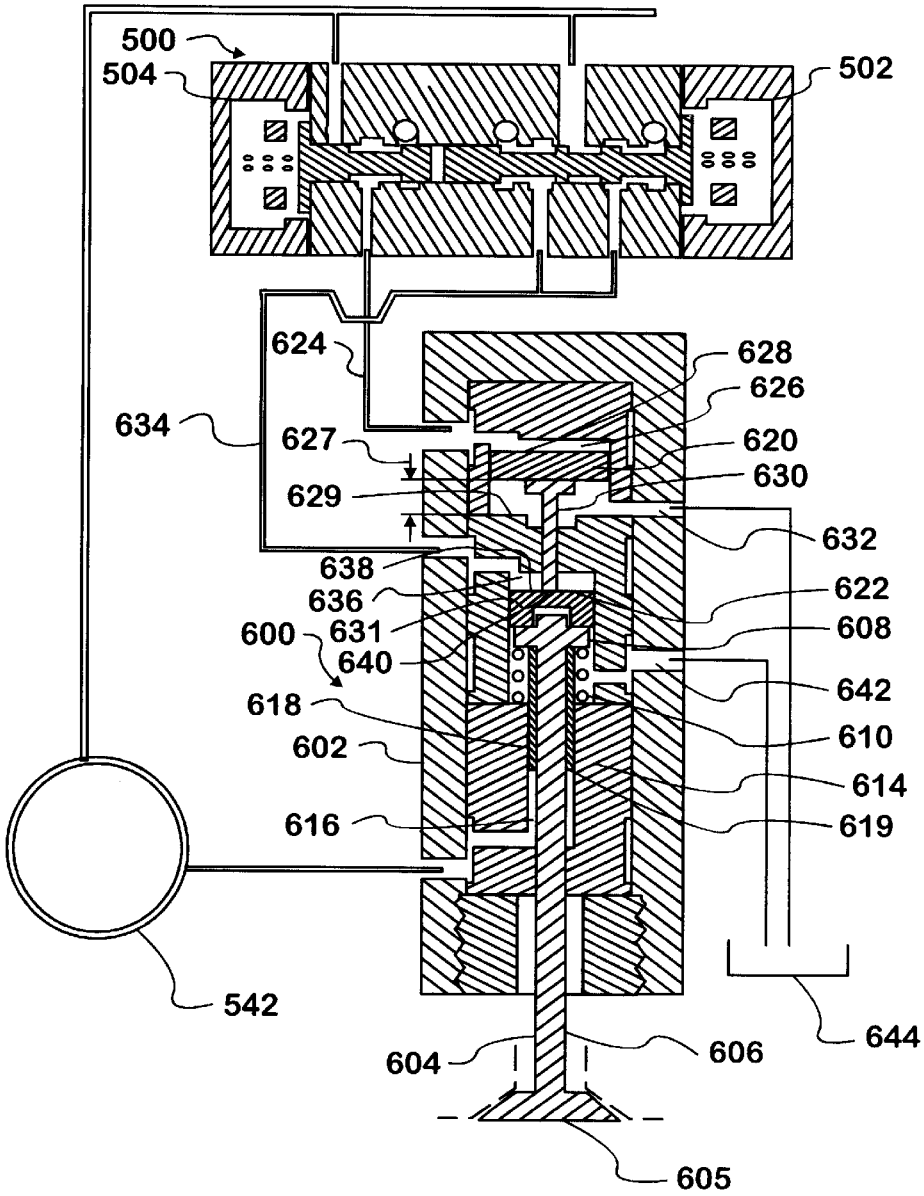
FIG. 7 is a sectional view of the valve actuation device of FIG. 6 integrated with the dual control valve of the present invention.
Figure 8:
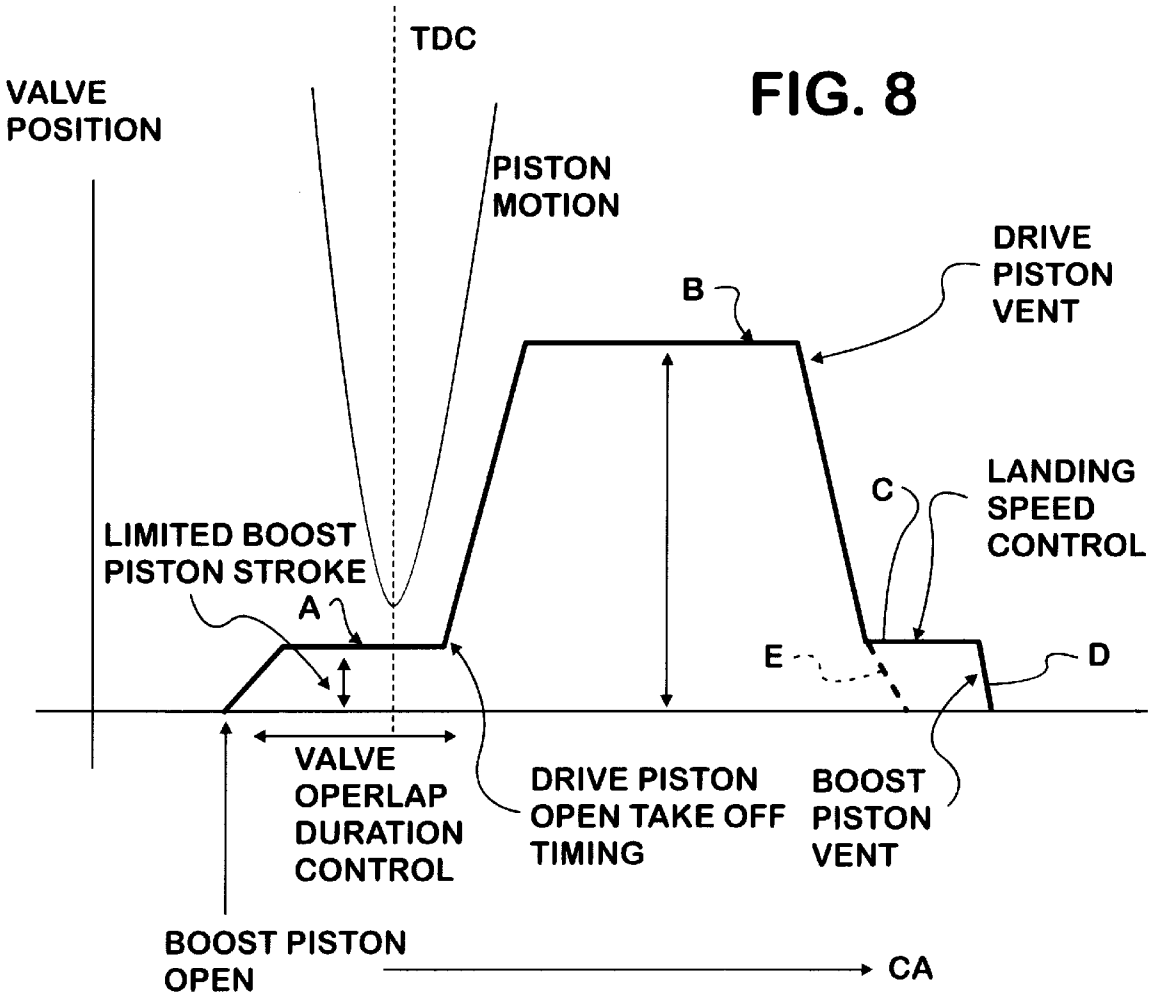
FIG. 8 is a graphic representation of the control strategy for the valve actuation device of FIGS. 6 and 7.

FIG. 6 depicts a camless actuator for an engine intake/exhaust valve 604. FIGS. 7 and 8 show the dual control valve 500 in application with the camless actuator of FIG. 6 on a camless engine. The engine intake/exhaust valve 604 has a valve face 605 that is exposed to the gas pressure in the combustion chamber. The engine intake/exhaust valve 604 has a valve stem 606 and a valve keeper 608. A valve spring 610 biases the valve 604 in a seated disposition against seat 612. The contact area beneath the keeper 608 is vented to ambient pressure by the vent 642 to the ambient reservoir 644.

The valve actuator 600 of the present invention has three major components: boost piston 620, drive piston 622 and return piston 618.

The boost piston 620 is translatable in a cylinder 625 defined in actuator housing 602. A variable volume boost piston control chamber 626 is defined in the cylinder 625 and is formed in part by the boost surface 628. The boost piston control chamber 626 is fluidly coupled to the half spool valve (timing control valve 504 in the description of FIGS. 2 and 3) by the passage 624. A depending shank 630 is operably couplable to the drive piston 620 at distal margin 631. The upper portion of the shank 630 is vented to ambient by vent 632. The stroke 627 of the boost piston 620 is limited by the stop 629.

Referring to FIGS. 6 and 7, pressure in the boost piston control chamber 626 is controlled by the half spool control valve 504. The boost piston chamber 626 of the boost piston 620 is connectable to the rail pressure from the actuating fluid rail 542 by the half spool control valve 504. When the half spool control valve 504 is turned on (see FIG. 3), the actuating fluid passes through the half spool valve 504 and passage 624 to the boost piston chamber 626. The boost surface 628 of the boost piston 620 has a relatively large area and it transmits sufficient downward force to the drive piston 622 and thence on the valve 604 to overcome the in-cylinder combustion pressure acting in opposition on the valve face 605. The boost piston 620 has of relatively limited stroke 627. Preferably, the stroke 627 is on the order of about 2 mm. It is desirable that the stroke 627 of the boost piston 620 be less than the cylinder head to combustion piston clearance at top dead center (TDC). The stroke limit 627 is realized by a hard stop 629 to the boost piston 620 travel. Due to the limited stroke 627 being less than the cylinder head to combustion piston clearance at TDC, boost piston 620 can be opened at any time without hitting the combustion piston without regard to combustion piston disposition relative to the cylinder head.

The responsibility of the boost piston 620 is to crack open the engine valve 604 the distance of the stroke 627 at a relatively high in-cylinder pressure condition and hold the valve 604 at the stroke limiter on the stop 629 for a selected period of time. This feature permits earlier use of the engine compression brake function and also permits engine valve overlap near TDC for internal exhaust gas recirculation.

The drive piston 622 positioning control pressure charge is controlled by the balance spool valve (referred to as the pressure control valve 502 with reference to the descriptions of FIGS. 2 and 3). The drive piston 622 and boost piston 620 are in mechanical contact (the distal end 631 of the boost shank 630 bearing on the drive area 638 of the drive piston 622) when the engine valve 604 opening is less than equal to the boost stroke 627 limit setting.

When engine valve 604 travel is greater than the boost limit (the stroke 627), the drive piston 622 and boost piston 620 are mechanically separated (the distal end 631 of the boost shank 630 is no longer bearing on the drive area 638 of the drive piston 622) and the drive piston 622 is responsible for fully opening the engine valve 604 without the assistance of the boost piston 620. The drive piston 622 and return piston 618 are always in mechanical contact with the engine valve 604.

The drive piston 622 is responsible for opening the engine valve 604 by overcoming all biased forces, including the force exerted by the return spring 610, the force exerted by the return piston 618, and any in-cylinder forces acting on the face 605 of the valve 604. The drive piston 622 has the capability to push the valve 604 to the full valve lift position and stay at that position for the entire duration of valve 604 opening. This is effected by appropriately sizing the drive area 638 to generate adequate force by the pressure to be exerted thereon by the actuating fluid ported to the drive piston chamber 636 by the open control valve 502 via the passage 634.

The drive piston 622 may be used sequentially or in conjunction with the boost piston 620 during the valve 604 actuation as desired to meet the valve 604 opening needs. The drive piston 622 is capable of traveling the full valve lift distance of valve 604 for any given actuation pressure (pressure in the rail 542) and stops when full travel is reached. How fast drive piston 622 moves is largely a function of the actuation pressure in the rail 542.

The return piston control chamber 616 is always exposed to actuating fluid pressure at the then current pressure in the rail 542. Accordingly, the return piston 618 is always connected to the rail pressure in the rail 542 without any control being exerted on the actuating fluid affecting the return piston 618. The force exerted by the actuating fluid on the surface 619 of the return piston 618 always tends to the push the valve 604 to the closed position in cooperation with the bias exerted by the return spring 610. The drive area 638 of the drive piston 622 is significantly greater than the area of the actuation surface 619 of the return piston 618, hence the drive piston 622 can always open the valve 604 against the force exerted by the return piston 618 acting in cooperation with the bias exerted by the return spring 610.

FIG. 8 illustrates the control strategy of the stepped valve motion method. Before the combustion piston reaches the TDC position, the half spool valve 504 is turned on, porting actuating fluid to the drive the boost piston 620 to its stroke limit 627 position on the stop 629. Since the drive piston 620 is in mechanical contact with the boost piston 622 at the home position, the entire moving mass (boost piston 620, drive piston 622 and the valve 604) is being pushed the distance of the stroke 627, about 2 mm, to the stop 629 and stopped at that position (see position A of FIG. 8).

The combustion piston continues its approach to TDC and passes TDC without hitting the cracked open engine valve 604. As soon as the piston passes TDC, the balanced spool valve 502 is turned on to trigger the drive piston 622 take off. Rail pressure is now in communication with the drive piston chamber 636 and acting on the drive area 638. The drive piston 622 mechanically separates from the boost piston 620 and pushes the engine valve 604 to the full open extent of its travel (see position B of FIG. 8) by overcoming the bias exerted by the return piston 618, the return spring 610 preload force and some in-cylinder pressure force acting on valve face 605. The engine valve 604 reaches its full open travel and stops.

After the desired engine valve opening duration, the balanced spool valve 502 is turned off and the drive piston chamber 636 is vented through vents 537. The return piston 618 and the return spring 610 then push the engine valve 604 and the drive piston 622 back to the 2 mm position (see position C of FIG. 9) where the drive piston 622 comes into contact again with the distal end 631 of the boost piston 620. Two different situations can happen at this returning position C.

The boost piston 620 is still in fluid communication with the rail pressure through the closed control valve 504 and the boost piston 620 is still set at its stroke limit 627 bearing on the stop 629. The return piston 618 carries the engine valve 604 and drive piston 622 together to hit the distal end 631 of the boost piston 620 and stops against the boost piston 620 due to significant force acting on the boost piston 620 by the actuating fluid in the boost piston chamber 626 acting on the boost surface 628. The engine valve 604 moving mass now is stopped at the 2 mm lift with the engine valve 604 cracked open as noted at position C in FIG. 8. After a selected period of time, the half spool control valve 504 is then shifted to the off position of FIG. 2 and vents the boost piston chamber 626 through the vent 539. The return piston 618 then pushes the entire mass (engine valve 604, drive piston 622 and boost piston 620 back to the home position (see FIG. 6) with very small landing velocity (see position D of FIG. 8). The very limited travel distance of the stroke 627 prevents developing high landing velocity before the mass is stopped. This method is very beneficial under high return speed when the engine is operating at relatively high RPM to minimize the valve 604 returning impact.

The second situation is as noted below. The boost piston chamber 626 is vented before the engine valve 604 returns to the 2 mm position. This occurs by the half spool control valve 504 being shifted to the off position and venting the boost piston chamber 626 through the vent 539. The returning drive piston 622 will then hit the distal end 631 of the boost piston 620. The entire moving mass is then increased by having to carry the boost piston 620, as well as the drive piston 622 and the valve 604 and this results in an increased system inertia. The entire moving mass accordingly slows down. The reduced return velocity effected by having to additionally carry the mass of the boost piston 620 acts to advantageously reduce the impact of the valve 604 on the cylinder head seat 612 (see position E of FIG. 8). This situation is advantageously used in low engine speed conditions and other low rail pressure conditions when the returning speed is relatively low.

With the dual control valve 500 of the present invention having two control valves 502, 504 and controlling one or more engine valves assures the safety of the valving mechanism 600. The combustion piston to the engine valve collision condition is avoided and return forces are minimized. With the two independent control valves 502, 504 and their corresponding actuators, flexible control of the engine valve motion without the risk of hitting the combustion piston becomes a reality. In general, the boost piston 620 can always be used to crack open the engine valve when the cylinder pressure is relatively high as may occur when the engine exhaust valve needs to open at very early timing or in engine brake application. If the engine valve opens under relatively low cylinder pressure, the drive piston 622 alone may be sufficient to overcome the cylinder force. The engine intake and exhaust valves do not need to have the same design, same architecture or the same control strategy.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A control apparatus for an engine valve, the engine valve being an intake/exhaust valve, the engine valve for admitting and exhausting a fluid mixture to and from a combustion chamber of an internal combustion engine, comprising;

a selectively actuatable controller being in fluid communication with a source of pressurized actuating fluid and being in fluid communication with a substantially ambient actuating fluid reservoir, the controller having a first control valve for selectively independently porting actuating fluid to and venting actuating fluid from a drive piston, the drive piston being operably coupled to the engine valve, and a second control valve for selectively independently porting actuating fluid to and venting actuating fluid from a boost piston, the boost piston being selectively operably coupled to the engine valve.

2. The control apparatus of claim 1 wherein the two control valves are disposed in a coaxial arrangement.

3. The control apparatus of claim 1 wherein the second control valve is operably fluidly coupled to a boost piston boost surface.

4. The control apparatus of claim 3 wherein actuating fluid ported by the second control valve to the boost piston boost surface generates a force acting to open the engine valve.

5. The control apparatus of claim 4 wherein the actuating fluid ported by the second control valve to the boost piston boost surface generates a force that is greater than an opposing in-cylinder force in the combustion chamber acting on the engine valve.

6. The control apparatus wherein 1 the boost piston has a stroke that is limited to a certain stroke length such that when the engine valve is opened the certain stroke length the engine valve is free of mechanical interference with a reciprocating engine piston in a cylinder served by the engine valve.

7. The control apparatus of claim 6 wherein the engine valve has a known full open stroke, the boost piston stroke being a portion of the full open stroke, the boost piston bearing on the drive piston for the length of the boost piston stroke, actuating fluid ported byte first control valve acting to separate the drive piston from the boost piston when the boost piston travel is limited at the boost piston stroke, the drive piston acting to open the engine valve the remainder of the full open stroke.

8. The control apparatus of claim 7 wherein engine valve is returned to an initial stopped disposition bearing on a stop at least in part by the bias exerted by a return spring, the return spring acting to return the engine valve and the drive piston toward the initial disposition responsive to the first control valve venting the actuating fluid from the drive piston, the drive piston contacting the boost piston proximate the initial stopped disposition, the mass of the boost piston acting to slow the return motion of the engine valve to minimize engine valve stopping impact on the stop.

9. The control apparatus of claim 8 wherein engine valve is returned to an initial stopped disposition bearing on a stop at least in part by the bias exerted by a return spring, the return spring acting to return the engine valve and the drive piston toward the initial disposition when the first control valve vents the actuating fluid from the drive piston, the drive piston contacting the boost piston proximate the initial disposition, the boost piston acting to stop the return motion of the engine valve and the drive piston, subsequent venting of the actuating fluid from the boost piston by the second control valve acting to free the engine valve, the engine valve returning to the initial stopped disposition with minimal stopping impact.

10. The control apparatus of claim 1 wherein the two control valves are axially spaced apart in all operating conditions.

11. The control apparatus of claim 1 wherein the first control valve is a balanced spool valve, flow being symmetrically directed on both sides of valve lands.

12. The control apparatus of claim 1 wherein the second control valve is a half spool valve.

13. The control apparatus of claim 1 wherein the second control valve is a poppet valve.

14. A control apparatus for an engine valve, the engine valve being an intake/exhaust valve, the engine valve for admitting and exhausting a fluid mixture to and from a combustion chamber of an internal combustion engine, comprising:

a selectively actuatable controller being in fluid communication with a source of pressurized actuating fluid and being in fluid communication with a substantially ambient actuating fluid reservoir, the controller having a first control valve for selectively independently porting actuating fluid to and venting actuating fluid from a drive piston, the drive piston being operably coupled to the engine valve, and a second control valve for selectively independently porting actuating fluid to and venting actuating fluid from a boost piston, the boost piston being selectively operably coupled to the engine valve, the two control valves are being independently electrically actuatable.

15. The control apparatus of claim 14 wherein the two control valves are independently solenoid operated in a first direction against a spring bias, the spring bias acting in an opposed second direction.

16. A control apparatus for an engine valve, the engine valve being an intake/exhaust valve, the engine valve for admitting and exhausting a fluid mixture to and from a combustion chamber of an internal combustion engine, comprising:

a selectively actuatable controller being in fluid communication with a source of pressurized actuating fluid and being in fluid communication with a substantially ambient actuating fluid reservoir, the controller having a first control valve for selectively independently porting actuating fluid to and venting actuating fluid from a drive piston, the drive piston being operably coupled to the engine valve, and a second control valve for selectively independently porting actuating fluid to and venting actuating fluid from a boost piston, the boost piston being selectively operably coupled to the engine valve, a return piston being operably coupled to the engine valve, the return piston being continually exposed to actuating fluid, the force generated on the return piston by the pressurized actuating fluid effecting an engine valve closing pressure.

17. The control apparatus of claim 16 wherein the force generated on the return piston by the pressurized actuating fluid acts in cooperation with an engine valve return spring.

18. The control apparatus of claim 17 wherein the force generated on the return piston by the pressurized actuating fluid varies as a function of the actuating fluid pressure.

19. A method of control for an engine valve, the engine valve being an intake/exhaust valve, the engine valve admitting and exhausting a fluid mixture into a combustion chamber of an internal combustion engine, comprising;

fluidly coupling a selectively actuatable controller being with a source of pressurized actuating fluid and with a substantially ambient actuating fluid reservoir;

selectively independently porting actuating fluid to and venting actuating fluid from a drive piston, the drive piston being operably coupled to the engine valve, by means of a first control valve; and selectively independently porting actuating fluid to and venting actuating fluid from a boost piston by means of a second control valve and selectively operably coupling the boost piston to the engine valve.

20. The method of claim 19 including operably fluidly coupling the second control valve to a boost piston.

21. The method of claim 20 including opening the engine valve by the second control valve porting actuating fluid to the boost piston.

22. The method of claim 21 including generating a force that is greater than an opposing force in the combustion chamber acting on the engine valve by means of the actuating fluid ported by the second control valve to the boost piston.

23. The method of claim 19 including:

limiting the stroke of the boost piston to a certain stroke length such that when the engine valve is opened the certain stroke length the engine valve is free of mechanical interference with a reciprocating engine piston in a cylinder served by the engine valve; and opening the engine valve of the boost piston stroke length by means of the boost piston.

24. The method of claim 23 wherein the engine valve has a known full open stroke, the boost piston stroke being a portion of the full open strokes including:

bearing the boost piston on the drive piston for the length of the boost piston stroke;

separating the drive piston from the boost piston when the boost piston travel is limited at the boost piston stroke by means of the actuating fluid ported by the first control valve to the drive piston; and opening the engine valve the remainder of the full open stroke by means of the drive piston.

25. The method of claim 24 including:

venting the actuating fluid from the drive piston by means of the first control valve;

returning the engine valve and the drive piston toward the initial disposition at least in part by the bias of the return spring;

contacting the boost piston proximate the initial disposition with the drive piston; and slowing the return motion of the engine valve to minimize the engine valve stopping impact by means of the mass of the boost piston.

26. The method of claim 24 including:

venting the actuating fluid from the drive piston by means of the first control valve;

returning the engine valve and the drive piston toward an initial disposition at least in part by the bias of the return spring;

contacting the boost piston proximate the initial disposition with the drive piston;

stopping the return motion of the engine valve by means of the mass of the boost piston; and venting of the actuating fluid from the boost piston by the second control valve to free the engine valve for return to the initial disposition with minimal stopping impact.

27. The method of claim 19 including axially spacing apart the two control valves in all operating conditions.

28. The method of claim 19 including balancing the first control valve by symmetrically directing flow on both sides of valve lands.

29. The method of claim 19 including:

operably coupling a return piston to the engine valve;

continually exposing the return piston being to actuating fluid; and effecting an engine valve closing pressure by means of a force generated on to return piston by the pressurized actuating fluid.

30. The method of claim 29 including varying the force generated on the return piston by the pressurized actuating fluid as a function of the actuating fluid pressure.

31. The method of claim 30 including generating an engine valve closing force by cooperatively coupling the force generated on the return piston by the pressurized actuating fluid and the bias exerted by the engine valve return spring.

32. A method of control for an engine valve, the engine valve being an intake/exhaust valve, the engine valve admitting and exhausting a fluid mixture into a combustion chamber of an internal combustion engine, comprising:

fluidly coupling a selectively actuatable controller being with a source of pressurized actuating fluid and with a substantially ambient actuating fluid reservoir;

selectively independently porting actuating fluid to and venting actuating fluid from a drive piston, the drive piston being operably coupled to the engine valve, by means of a first control valve;

selectively independently porting actuating fluid to and venting actuating fluid from a boost piston by means of a second control valve and selectively operably coupling the boost piston to the engine valve;

independently shifting each of the two control valves in a respective first direction by respective solenoids; and independently shifting each of the two control valves in a second opposed direction by spring bias.

33. A valve actuator for actuating an engine valve, the engine valve being an intake/exhaust valve, the engine valve admitting and exhausting a fluid mixture into a combustion chamber of an internal combustion engine, comprising;

a drive piston being operably coupled to the engine valve, the drive piston being selectively fluidly couplable to a controller, the controller having a first control valve for selectively independently porting actuating fluid to and venting actuating fluid from the drive piston; and a boost piston being selectively operably coupled to the engine valve, the boost piston being selectively fluidly couplable to a controller, the controller having a second control valve for selectively independently porting actuating fluid to and venting actuating fluid from the boost piston.

34. The valve actuator of claim 33 wherein the boost piston has a stroke that is limited to a certain stroke length such that when the engine valve is opened the certain stroke length the engine valve is flee of mechanical interference with a reciprocating engine piston in a cylinder served by the engine valve.

35. The valve actuator of claim 34 wherein the engine valve has a known full open stroke, the boost piston stroke being a portion of the full open stroke, the boost piston bearing on the drive piston for the length of the boost piston stroke, the drive piston separating from the boost piston when the boost piston travel is limited at the boost piston stroke, the drive piston acting to open the engine valve the remainder of the full open stroke.

36. The valve actuator of claim 35 wherein engine valve and drive piston are returned to an initial stopped disposition at least in part by the bias exerted by a return spring, the returning drive piston contacting the boost piston proximate the initial disposition, the mass of the boost piston acting to slow the return motion of the engine valve to minimize the engine valve stopping impact.

37. The valve actuator of claim 35 wherein engine valve and drive piston are returned to an initial disposition at least in part by the bias exerted by a return spring, the returning drive piston contacting the boost piston proximate the initial disposition, the boost piston stopping the return motion of the engine valve and the drive piston, and subsequent returning motion of the boost piston acting to simultaneously return the engine valve to the initial disposition with minimal stopping impact.

38. The valve actuator of claim 33 wherein the boast piston and the drive piston are disposed in a coaxial relationship.

39. The valve actuator of claim 33 wherein a return piston is operably coupled to the engine valve, a force generated on the return piston effecting an engine valve closing pressure.

40. The valve actuator of claim 39 wherein the force generated on the return piston acts in cooperation with the bias exerted by an engine valve return spring.

41. The valve actuator of claim 39 wherein the force generated on the return piston is variable as a function of an actuating fluid pressure.

* * * * *